US007647011B2

(12) United States Patent
Hayashi

(10) Patent No.: US 7,647,011 B2
(45) Date of Patent: Jan. 12, 2010

(54) TONER CONTAINER AND IMAGE FORMING APPARATUS PROVIDED WITH TONER CONTAINER

(75) Inventor: Masaki Hayashi, Osaka (JP)

(73) Assignee: Kyocera Mita Corporation (JP)

( * ) Notice: Subject to any disclaimer, the term of this patent is extended or adjusted under 35 U.S.C. 154(b) by 434 days.

(21) Appl. No.: 11/796,444

(22) Filed: Apr. 27, 2007

(65) Prior Publication Data

US 2007/0286645 A1 Dec. 13, 2007

(30) Foreign Application Priority Data

May 18, 2006 (JP) ..... 2006-139029

(51) Int. Cl.
*G03G 15/08* (2006.01)

(52) U.S. Cl. ..... 399/262; 399/120; 399/258; 399/260

(58) Field of Classification Search ..... 399/104, 399/119, 120, 258, 260, 262
See application file for complete search history.

(56) References Cited

U.S. PATENT DOCUMENTS 5,148,223 A * 9/1992 Cipolla ..... 399/258
5,426,492 A * 6/1995 Diehl ..... 399/262
5,970,303 A * 10/1999 Bares et al. ..... 324/760

FOREIGN PATENT DOCUMENTS

JP 2002-278424 9/2002

* cited by examiner

*Primary Examiner*—David M Gray
*Assistant Examiner*—Benjamin Schmitt
(74) *Attorney, Agent, or Firm*—Gerald E. Hespos; Anthony J. Casella

(57) ABSTRACT

A toner container adapted to be detachably attached to a developer provided in an apparatus body of an image forming apparatus includes a casing for loading a toner therein. The casing has a bottom wall formed with a replenishing port for replenishing the toner to the developer. A sheet member is placed on the bottom wall. The sheet member has a first end fixed to the casing near the replenishing port, and a second end opposite to the first end. The second end is movable up and down. A first magnet is attached to a lead end of the second end of the sheet member, and a guide to guide the up and down movement of the first magnet. The first magnet is upwardly movable while being guided by the guide by a repulsion force resulting from application of a certain magnetic force to the first magnet.

17 Claims, 5 Drawing Sheets

TONER CONTAINER AND IMAGE FORMING APPARATUS PROVIDED WITH TONER CONTAINER

BACKGROUND OF THE INVENTION

1. Field of the Invention

The present invention relates to a toner container detachably attached to a developer provided in an apparatus body of an image forming apparatus, and an image forming apparatus provided with the toner container.

2. Description of the Related Art

An electrophotographic image forming apparatus generally has, in the periphery of a photosensitive drum as an image carrier, a charger, an exposure unit, a developer, a transferer, and a cleaner. An electrostatic latent image is formed on the surface of the photosensitive drum by irradiating light representing image information from the exposure unit onto the surface of the photosensitive drum where uniform electric charges are supplied by the charger. Then, the electrostatic latent image is developed into a toner image by supplying toner i.e. toner particles (hereinafter, toner particles are simply called as "toner") onto the electrostatic latent image by the developer. Then, the toner image is transferred onto a sheet. The sheet carrying the transferred toner image is transported to a fixing device provided downstream of the photosensitive drum, where the toner image is fixed by heating. After the image fixation, the sheet carrying the fixed toner image is discharged outside of the image forming apparatus.

Normally, a toner container is detachably attached to the developer. A toner replenishing port is formed at an appropriate position in a bottom wall of the toner container so that the toner accommodated in the toner container is replenished to the developer through the replenishing port. When the toner in the toner container is reduced to such an amount that toner replenishment to the developer is incapable as a result of developing process, the toner container is replaced with a new toner container filled with toner.

It is often the case that the bottom wall of the toner container is formed into e.g. a funnel-like shape with a slope tilted toward the replenishing port so as to replenish the toner in possible total amount to the developer. The arrangement is proposed based on an expectation that the toner in the toner container may be guided along the slope, and substantially all the toner in the toner container may be replenished to the developer.

Forming the bottom wall into a funnel-like shape, however, not only leads to a reduced capacity of the toner container, but also leads to forming a waste space corresponding to the funnel portion in the apparatus body of the image forming apparatus. As a result, miniaturization of the image forming apparatus may be hindered.

In view of the above, there is proposed an arrangement of forming the bottom wall of the toner container into a horizontally flat plate (see e.g. Japanese Unexamined Patent Publication No. 2002-278424). Forming the bottom wall of the toner container into a flat plate may be advantageous in increasing the capacity of the toner container by the space corresponding to the funnel portion, and in miniaturizing the image forming apparatus.

Forming the bottom wall of the toner container into the flat plate, however, may obstruct guiding the toner toward the replenishing port, which makes is impossible to replenish all the toner in the toner container to the developer. As a result, the toner container is required to be replaced with a new one, despite toner remainder in the toner container. This is waste of toner.

In other words, the conventional toner container has contradictory problems to be solved: forming the bottom wall of the toner container into a funnel-like shape in an attempt to eliminate toner remainder may obstruct miniaturization of the image forming apparatus; and forming the bottom wall into a flat shape in an attempt to miniaturize the image forming apparatus may increase the amount of toner remainder in the toner container.

SUMMARY OF THE INVENTION

In view of the above problems residing in the conventional examples, it is an object of the present invention to provide a toner container that enables to secure a large capacity of the container, contribute to miniaturization of an image forming apparatus, and to minimize the amount of toner remainder in the container, as well as an image forming apparatus provided with the toner container.

A toner container according to an aspect of the invention comprises: a toner container adapted to be detachably attached to a developer provided in an apparatus body of an image forming apparatus. The toner container comprises: a casing member for loading a toner therein, the casing member including a bottom wall formed with a replenishing port for replenishing the toner to the developer; a sheet member placed on the bottom wall, the sheet member including a first end fixed to the casing member near the replenishing port, and a second end opposite to the first end, the second end being made movable up and down; a first magnet attached to a lead end of the second end of the sheet member; and a guide member for guiding the up and down movement of the first magnet, wherein the first magnet is upwardly movable while being guided by the guide member by a repulsion force resulting from application of a certain magnetic force to the first magnet.

An image forming apparatus according to another aspect of the invention comprises: an apparatus body; an image carrier incorporated in the apparatus body; a developer for forming a toner image by supplying a toner onto a surface of the image carrier; and a toner container detachably attached to the developer, wherein the toner container has the aforementioned arrangement.

These and other objects, features and advantages of the present invention will become more apparent upon reading the following detailed description along with the accompanying drawing.

DETAILED DESCRIPTION OF THE PREFERRED EMBODIMENTS

Figure 1:
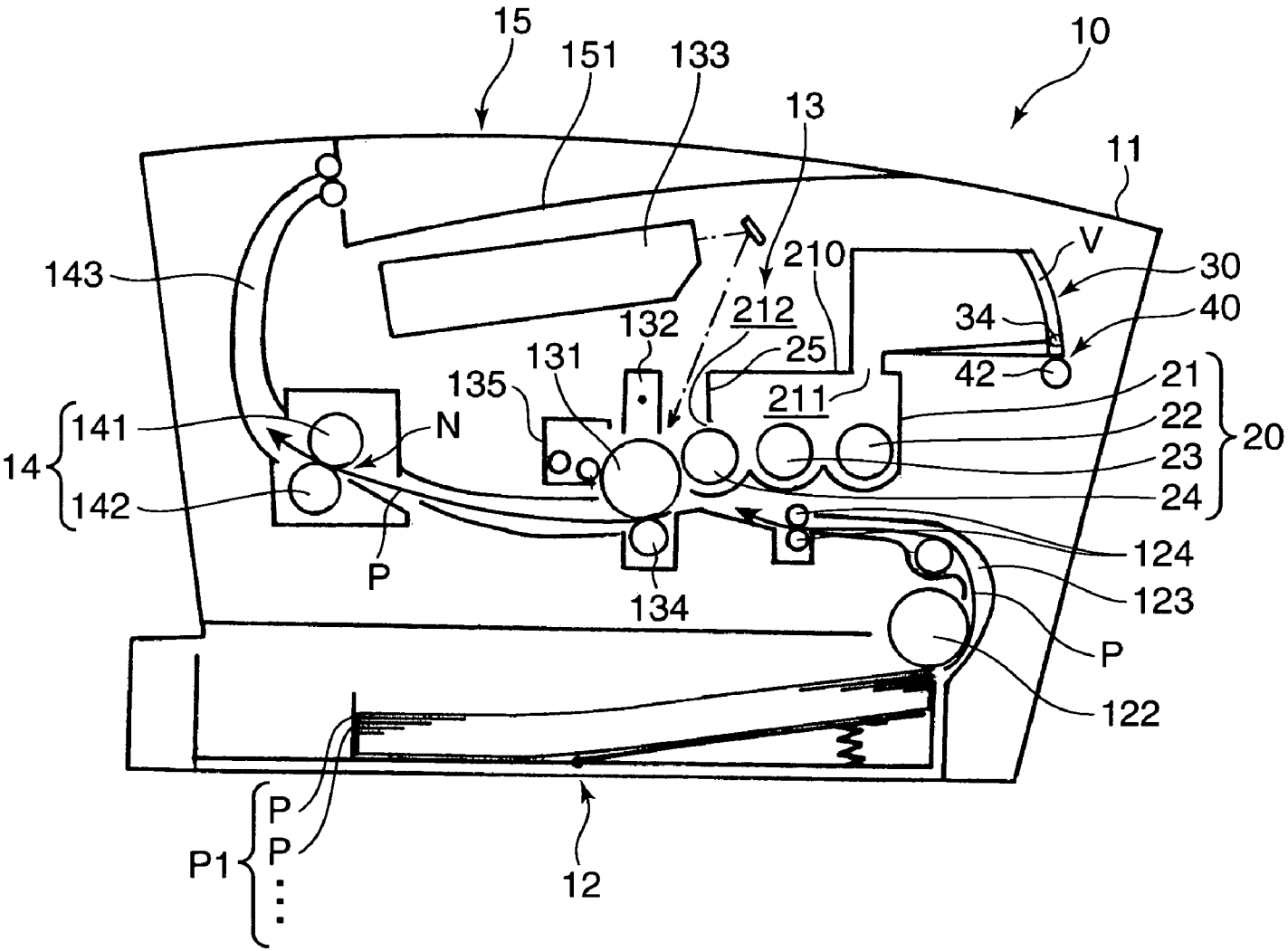
FIG. 1 is a cross-sectional side view showing an embodiment of a printer to which a toner container embodying the invention is applied.

FIG. 1 is a cross-sectional side view showing an embodiment of a printer 10 to which a toner container 30 embodying the invention is applied. The printer 10, an example of an image forming apparatus, has an apparatus body 11. A sheet storage 12 for storing a stack P1 of sheets for printing, an image former 13 for forming an image on each sheet P which is fed from the sheet stack P1 stored in the sheet storage 12, and an image fixer 14 for fixing the image on the sheet P after the image formation are provided in the apparatus body 11. The printer 10 is further provided with a sheet discharger 15, at a top part of the apparatus body 11, for discharging the sheet P after the image fixation in the image fixer 14.

A predetermined number of (in this embodiment, one) sheet cassettes 121 are detachably provided in the sheet storage 12. A pickup roller 122 is arranged at an upstream end of the sheet cassette 121 i.e. at a right position in FIG. 1 for feeding the sheets P one by one from the sheet stack P1. The sheet P fed from the sheet cassette 121 by driving the pickup roller 122 is transported to the image former 13 along a sheet transport path 123 and by way of a registration roller pair 124 provided at a downstream end of the sheet transport path 123.

The image former 13 transfers an image onto the sheet P based on image information electronically transmitted from a computer or a like device. The image former 13 is provided with a photosensitive drum 131, as an image carrier, which is rotatably supported to the apparatus body 11 about an axis of rotation of the photosensitive drum 131 extending in a depthwise direction of the apparatus body 11 i.e. a direction orthogonal to the plane of FIG. 1. The image former 13 further includes, along the surface of the photosensitive drum 131 in clockwise direction in the order from the position immediately above the photosensitive drum 131, a charger 132, an exposure unit 133, a developer 20 to which the toner container 30 is detachably attached, a transfer roller 134, and a cleaner 135.

The photosensitive drum 131 is adapted to form an electrostatic latent image, and a toner image i.e. a developing agent image on the surface thereof. Preferably, a flat and rigid amorphous silicon layer may be formed on the surface of the photosensitive drum 131.

The charger 132 is adapted to form uniform electric charges on the surface of the photosensitive drum 131 which is rotated in clockwise direction about the axis of rotation of the photosensitive drum 131. The example shown in FIG. 1 adopts a technique of applying electric charges to the surface of the photosensitive drum 131 by corona discharge. A charging roller for applying electric charges, with its surface being rotated in contact with the surface of the photosensitive drum 131, may be used as a member for applying electric charges to the surface of the photosensitive drum 131, in place of the charger 132.

The exposure unit 133 irradiates, onto the surface of the rotating photosensitive drum 131, laser light whose intensity is controlled based on image data electronically transmitted from an external device such as a computer. An electrostatic latent image is formed on the surface of the photosensitive drum 131 by removing the electric charges corresponding to the area of the drum surface irradiated by the laser light.

The developer 20 is adapted to magnetically attract toner onto the area of the drum surface where the electrostatic latent image is formed by supplying the toner to the surface of the photosensitive drum 131 to thereby form a toner image on the surface of the photosensitive drum 131. The developer 20 is constructed by mounting various parts to be described later in a developer body 21 of the developer 20, which is arranged immediately on the right side of the photosensitive drum 131. The toner container 30 is detachably attached to an upper portion of the developer body 21 at a right position in FIG. 1, and is adapted to replenish a developing agent (in this embodiment, toner) to the developer body 21.

There are two types of developing agent: one is a single component developing agent composed of a toner, and the other is a two component developing agent composed of a toner and carrier. The toner is fine particles, with a particle diameter of 6 to 12 μm, obtained by dispersing additives such as a colorant, a charge controlling agent, and a wax in a binder resin. The carrier is magnetic particles, with a particle diameter of 60 to 200 μm, made of magnetite ($Fe_3O_4$) or a like material. The carrier is used to charge the toner. Whereas the toner is an expendable which is required to be replenished from the toner container 30 to the developer 20 according to needs, the carrier is generally circulatively used without being consumed in a state that a predetermined amount of the carrier is loaded in the developer 20.

The developer body 21 includes, in the box-shaped developer body 21, a first screw feeder 22, a second screw feeder 23, and a developing roller 24, each of which extends in a direction substantially orthogonal to the plane of FIG. 1. The first screw feeder 22, the second screw feeder 23, and the developing roller 24 are arranged side by side from the right side toward the left side in FIG. 1.

A toner receiving port 211 is formed in a top wall 210 of the developer body 21 immediately above the first screw feeder 22 to receive the toner from the toner container 30 into the developer body 21. A toner supply port 212 is formed in a left wall of the developer body 21 in FIG. 1 to supply the toner to the photosensitive drum 131. The toner supply port 212 extends over the substantially entire length of the developer body 21 in a direction substantially orthogonal to the plane of FIG. 1.

The toner introduced from the toner container 30 through the toner receiving port 211 is circulated inside the developer body 21 while being stirred by driving rotation of the first and the second screw feeders 22 and 23. A part of the circulating toner is supplied to the surface of the photosensitive drum 131 by way of the surface of the driving rotating developing roller 24.

A layer thickness regulation blade 25 is provided above the toner supply port 212. The layer thickness regulation blade 25 suspends from the top wall 210 of the developer body 21, with its lower end being opposed to the surface of the developing roller 24. As the developing roller 24 is rotated about its axis of rotation in counterclockwise direction, the toner is supplied from the surface of the developing roller 24 toward the photosensitive drum 131. While the toner is supplied through a clearance between the layer thickness regulation blade 25 and the surface of the developing roller 24, the thickness of the toner is regulated to a predetermined thickness.

The first screw feeder 22, the second screw feeder 23, and the developing roller 24 are driven synchronously by transmission of a driving force of an unillustrated drive motor by way of a gear mechanism.

The transfer roller 134 is adapted to transfer a toner image which is positively charged on the surface of the photosensitive drum 131 onto a sheet P transported to a position immediately below the photosensitive drum 131. The transfer roller 134 applies negative electric charges, which is opposite to the electric charges of the toner image, to the sheet P.

When the sheet P has reached the position immediately below the photosensitive drum 131, the toner image is transferred onto the sheet P which is pressingly held between the transfer roller 134 and the photosensitive drum 131. The transfer process of the sheet P is a process of magnetically attracting the toner image formed on the positively-charged surface of the photosensitive drum 131 toward the surface of the sheet P which is negatively charged by the transfer roller 134.

The cleaner 135 is adapted to clean the photosensitive drum 131 after the transfer process by removing toner residuals from the surface of the photosensitive drum 131. After the surface of the photosensitive drum 131 is cleaned by the cleaner 135, the photosensitive drum 131 faces the charger 132 again.

The image fixer 14 is adapted to fix the toner image on the sheet P by heating after the transfer process in the image former 13. The image fixer 14 includes a fixing roller 141 for applying heat to the sheet P, and a pressure roller 142 which is opposingly arranged below the fixing roller 141. After the transfer process, the sheet P is transported toward a nip portion N between the fixing roller 141 and the pressure roller 142. An image fixing process is performed by applying heat to the sheet P from the fixing roller 141 while the sheet P passes the nip portion N. After the image fixing process, the sheet P is discharged to the sheet discharger 15 along a sheet discharge path 143.

The sheet discharger 15 is defined by forming the top part of the apparatus body 11 into a recess. A bottom portion of the recess serves as a discharge tray 151 for receiving the discharged sheet P.

Figure 2:
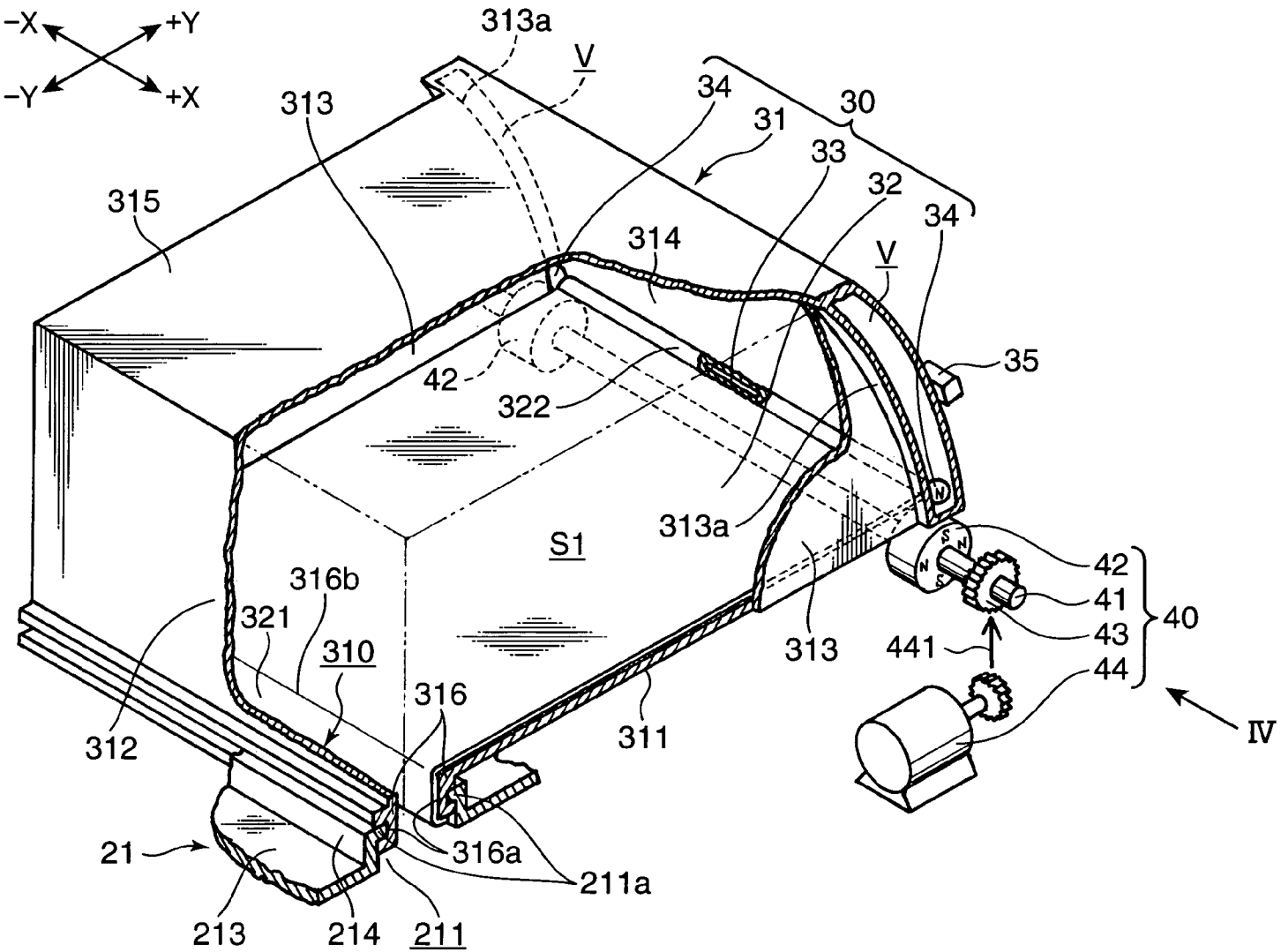
FIG. 2 is a partially cutaway perspective view showing an embodiment of the toner container, wherein a sheet member is set to a horizontal position.
Figure 3:
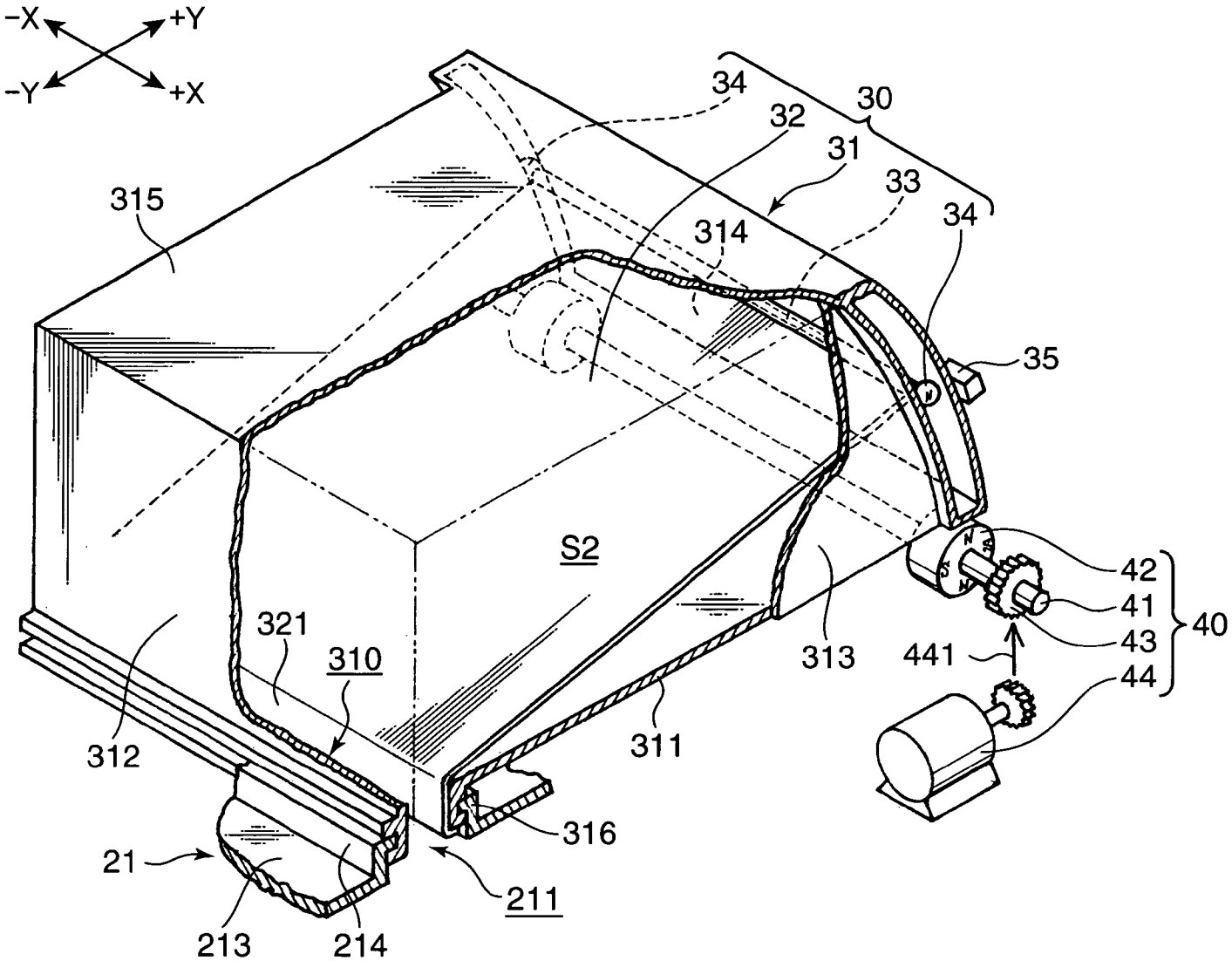
FIG. 3 is a perspective view showing a state that the sheet member shown in FIG. 2 is set to a maximally tilted position.
Figure 4:
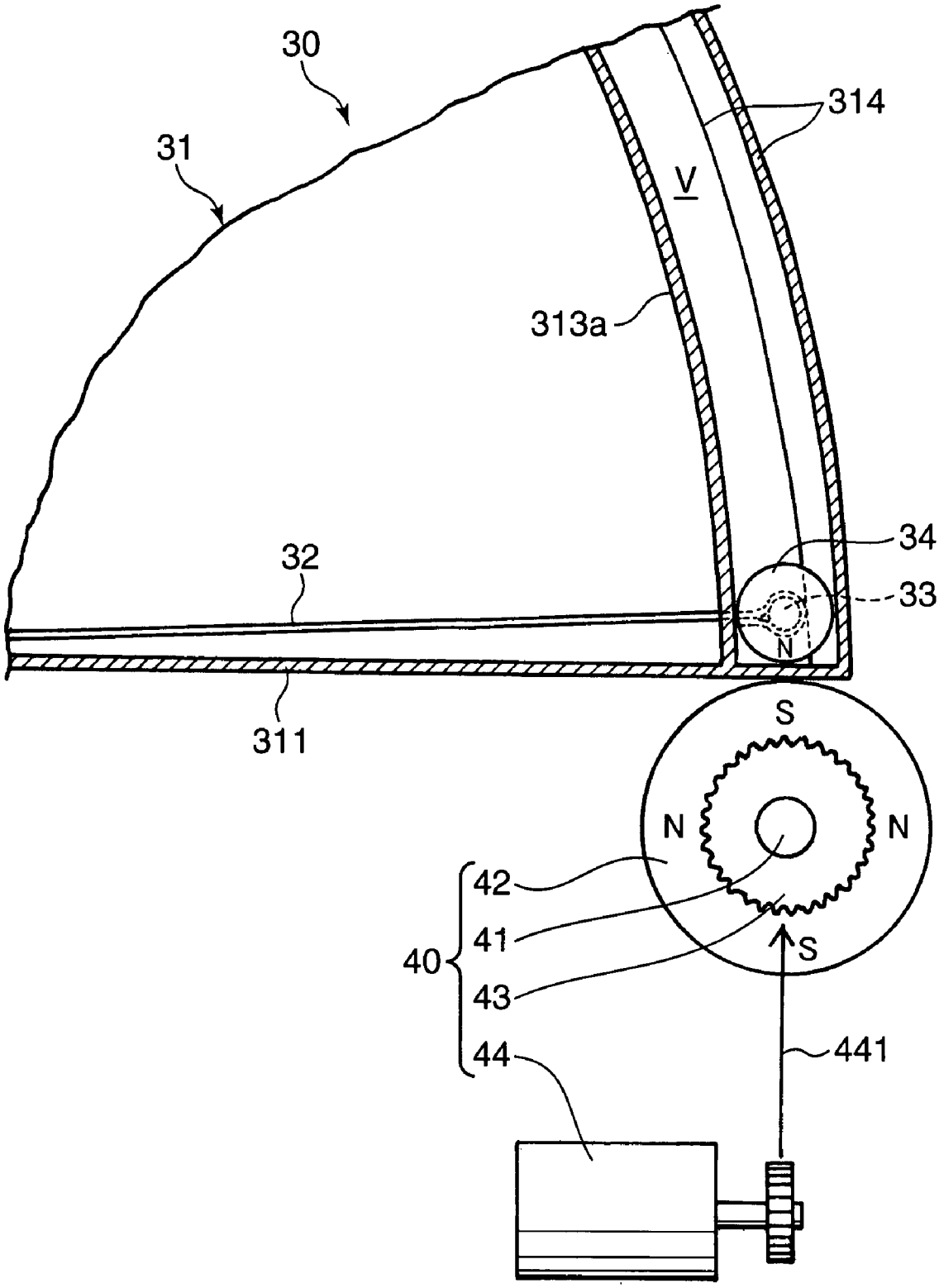
FIG. 4 is an enlarged view viewed from the direction IV in FIG. 2.

FIGS. 2 and 3 are partially cutaway perspective views showing an embodiment of the toner container 30. FIG. 2 shows a state that a sheet member 32 is set to a horizontal position S1, and FIG. 3 shows a state that the sheet member 32 is set to a maximally tilted position S2. FIG. 4 is a an enlarged view viewed from the direction IV in FIG. 2. Throughout FIGS. 2 through 4, X-X directions are called as left and right directions, and Y-Y directions are called as forward and backward directions. Particularly, −X direction is called as leftward direction, +X direction is called as rightward direction, −Y direction is called as forward direction, and +Y direction is called as backward direction.

As shown in FIGS. 2 and 3, the toner container 30 basically has a substantially parallelepiped box-like shape, and includes a container body 31, as a casing member, for accommodating toner therein, the sheet member 32 provided in the container body 31, a rod member 33 provided at a rear end, as a second end, of the sheet member 32, and a pair of end magnets 34, as a first magnet, which are fixed to both ends of the rod member 33 in the left and right directions.

The container body 31 includes a bottom wall 311 which has a rectangular shape in plan view and is formed substantially horizontally, a replenishing port 310 which is formed at a front end, as a first end portion, of the bottom wall 311, and extends over the substantially entire length of the container body 31 in the left and right directions, a front wall 312 which is formed upright from a front end of the replenishing port 310, a pair of side walls 313 which are formed upright from both ends of the bottom wall 311 in the left and right directions, a rear wall 314 extending upwardly from a rear end, as a second end portion, of the bottom wall 311, and a top wall 315 which extends to the side wall pair 313 and an upper end of the front wall 312.

An engaging portion 316 which extends downwardly from the bottom wall 311, with a vertically through hollow, is formed at a position below the replenishing port 310. Engaging grooves 316*a* extending over the substantially entire length of the engaging portion 316 are formed in an outer surface of a front wall and in an outer surface of a rear wall of the engaging portion 316, respectively. Atop wall 213 of the developer body 21 has an attachment support 214 which is detachably engageable with the engaging portion 316 in the left and right directions.

The attachment support 214 defines the toner receiving port 211 for receiving the toner from the toner container 30 into the developer body 21 through the replenishing port 310. Engaging ribs 211*a*, extending in the left and right directions, are formed at upper ends of the attachment support 214 so that the engaging ribs 211*a* are engaged in the engaging grooves 316*a* in sliding contact therewith. The toner container 30 is detachably attached to the developer 20 by slidably drawing the engaging ribs 211*a* in and out of the engaging grooves 316*a*.

A lower opening of the engaging portion 316 is covered by an unillustrated cover sheet e.g. an adhesive sheet to prevent the toner in the container body 31 from falling through the replenishing port 310 before the toner container 30 is attached to the developer 20. A user is allowed to attach the toner container 30 to the developer 20 by slidably engaging the engaging portion 316 with the attachment support 214 while peeling off the cover sheet. Thereby, the toner container 30 is attached to the developer 20, while preventing toner leakage.

The sheet member 32 has an effective surface, i.e. a surface where the toner is loaded, whose area is substantially the same as the area of the bottom wall 311. With this arrangement, substantially all the toner in the container body 31 is loaded on the sheet member 32 except for an area corresponding to the replenishing port 310. The sheet member 32 has a front end 321, as a first end, which is fixedly supported to an end portion of the replenishing port 310 i.e. an inner surface of the rear walls of the engaging portion 316 by adhesion or a like technique.

The rod member 33 extends in a cylindrical portion 322 which is defined by winding the rear end, as the second end, of the sheet member 32. The rod member 33 has a length slightly larger than the length of the cylindrical portion 322. With this arrangement, the rod member 33 is slightly protruded from both ends of the cylindrical portion 322 in a state that the rod member 33 extends in the cylindrical portion 322.

The end magnets 34 each has a spherical shape, as shown in FIGS. 2 and 3. The end magnet 34 has a north pole at an outer portion thereof, and a south pole at a central portion thereof i.e. an inner portion through which the rod member 33 extends.

The rear wall 314 has an inner surface formed into an arc-shape, with an upper corner position of the front end 321 of the sheet member 32 i.e. a position 316*b* where an inner corner portion of the engaging portion 316 is bent by about 90 degrees, serving as a center of curvature; and with a distance between the front end 321 and the rear end of the sheet member 32, serving as a radius of curvature. Also, the side walls 313 each has an arc-shaped guide rail 313*a*, as a guide member, at a position slightly forward of the rear wall 314. The guide rail 313*a* projects outwardly in sliding contact with a front end of the end magnet 34, with the upper corner position of the front end 321 serving as a center of curvature, and with the distance between the front end 321 and the front end of the end magnet 34 serving as a radius of curvature.

The guide rails 313*a* project outwardly from the side walls 313, respectively. The length of the rear wall 314 in the left and right directions is set slightly larger than the outer distance between the side walls 313 so as to install the guide rails 313*a*. With this arrangement, there is defined a guide space V between each of the guide rails 313*a* and the rear wall 314, in which the end magnet 34 is moved up and down while being guided along the corresponding guide rail 313*a*. In other words, arc-shaped projections projecting outwardly in the left and right directions are formed on the rear end of the container body 31 for defining the guide spaces V.

The sheet member 32 is movable between the horizontal position S1 shown in FIG. 2 and the maximally tilted position S2 shown in FIG. 3 by way of the rod member 33, as the end magnets 34 are moved up and down while being guided in the guide spaces V.

The sheet member 32 has such dimensions that end portions thereof in the left and right directions are slidably contacted with the side walls 313 of the container body 31, and a rear portion of the cylindrical portion 322 is slidably contacted with the rear wall 314 of the container body 31 in a state that the sheet member 32 is placed on the bottom wall 311 of the container body 31. The dimension setting enables to prevent the toner on the sheet member 32 from falling onto the bottom wall 311.

In this embodiment, an elevating mechanism 40 is provided in the apparatus body 11 of the printer 10 to move the end magnet pair 34 up and down. As shown in FIGS. 2 through 4, the elevating mechanism 40 includes a shaft 41 which is arranged at a position immediately below the toner container 30 in the apparatus body 11 and extends in the left and right directions in parallel with the rod member 33; a pair of magnet rollers 42, as a second magnet, which are concentrically mounted on the shaft 41 to be integrally rotatable, and are arranged opposing to the respective corresponding end magnets 34; a drive gear 43 which is concentrically mounted on one end of the shaft 41 to be integrally rotatable; and a drive motor 44 for transmitting a driving force thereof to the drive gear 43 via a gear mechanism 441.

The magnet rollers 42 each has, as shown in FIG. 4, plural unit magnets on a peripheral portion thereof, with its north pole and a south pole being alternately arranged with a phase interval of 90°. The magnet rollers 42 are integrally rotated about the axis of rotation of the shaft 41 via the gear mechanism 441 and the drive gear 43 by driving the drive motor 44. The end magnets 34 each generates a repulsing magnetic force when the north pole of the corresponding magnet roller 42 faces the end magnet 34, and is magnetically attracted to the magnet roller 42 when the south pole of the magnet roller 42 faces the end magnet 34.

In this embodiment, a magnetic field sensor 35, as a sensor, is provided to detect one of the end magnets 34. The magnetic field sensor 35 is provided at a position on the outer surface of the rear wall 314, corresponding to one of the guide spaces V, and corresponding to a predetermined maximal height of the end magnet 34. The magnetic field sensor 35 is a measuring device capable of detecting a magnetic flux density of the end magnet 34. For instance, data representing a magnetic flux density when the end magnet 34 is set to the maximal height may be stored in an unillustrated controller. Then, the controller may compare a magnetic flux density detected by the magnetic field sensor 35 with the pre-stored input value representing the magnetic flux density at the maximal height, and judge that the end magnet 34 has reached the maximal height when these values are identical to each other.

The maximal height of the end magnet 34 is a selected height position which enables to set the sheet member 32 to such a tilt angle as to fall substantially all the toner from the sheet member 32. With this arrangement, when the magnetic field sensor 35 detects the end magnet 34, the toner in the container body 31 is almost entirely consumed, in other words, the container body 31 is empty. Then, the toner container 30 is replaced with a new one based on the detection result of the magnetic field sensor 35.

Figure 5A:
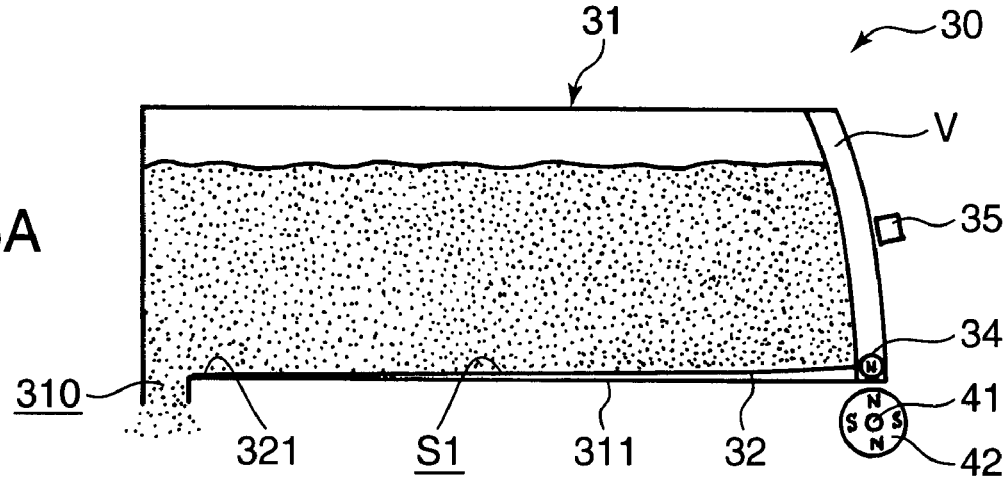
FIGS. 5A through 5C are cross-sectional side views of the toner container for describing an operation of an elevation mechanism.
Figure 5B:
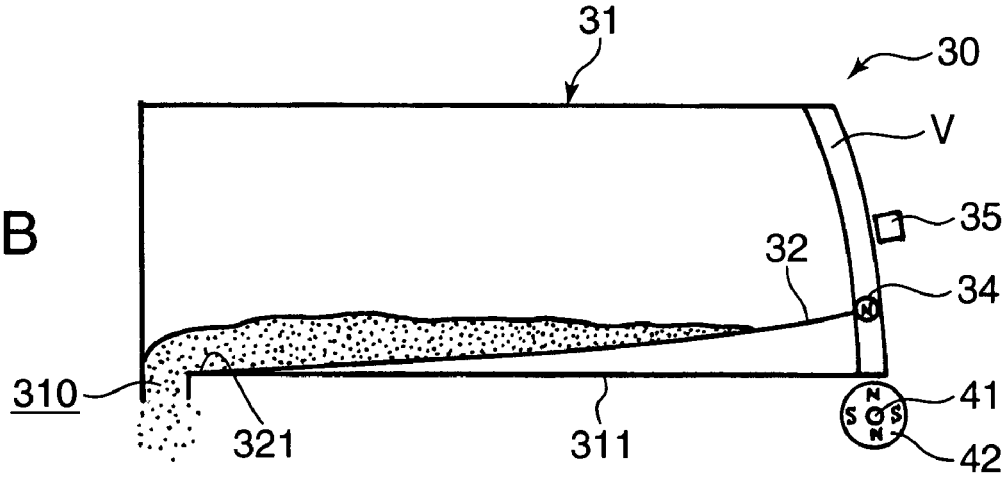
Figure 5C:
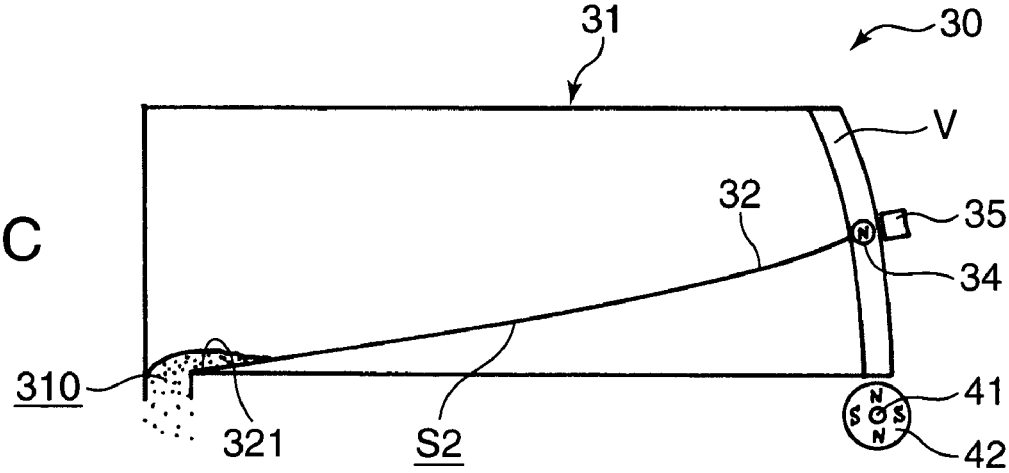

FIGS. 5A through 5B are cross-sectional side views of the toner container 30 for describing an operation of the elevating mechanism 40. FIG. 5A shows a state that the toner is full in the container body 31. FIG. 5B shows a state that toner remainder in the container body 31 is in a medium level. FIG. 5C shows a state that the toner in the container body 31 is almost entirely consumed.

First, as shown in FIG. 5A, in a state that the toner is full in the container body 31, a certain weight corresponding to a large amount of toner is applied to the sheet member 32. Accordingly, even if the north poles of the magnet rollers 42 face the respective corresponding end magnets 34, there is no likelihood that the end magnets 34 are moved upward against the weight of the toner. Thus, the sheet member 32 is set to the horizontal position S1.

As the toner is consumed by a developing process in the developer 20, the toner in the container body 31 is replenished into the developer body 21 (see FIG. 1) through the replenishing port 310. Thereby, the amount of toner on the sheet member 32 is decreased. As a result, the weight of the toner on the sheet member 32 is gradually decreased against the repulsion force of the magnet rollers 42. Then, as shown in FIG. 5B, when the north poles of the magnet rollers 42 face the respective corresponding end magnets 34, the end magnets 34 are moved upward while being guided in the guide spaces V by a repulsion force between the magnet rollers 42 and the end magnets 34. Thereby, the sheet member 32 attached with the end magnets 34 at the rear end thereof is tilted by a certain angle with respect to the bottom wall 311, with the front end 321 being set to a lowest position.

Then, as the south poles of the magnet rollers 42 face the respective corresponding end magnets 34 by rotation of the magnet rollers 42 about the axis of rotation of the shaft 41, the end magnets 34 are magnetically attracted to the magnet rollers 42, and, as a result, the sheet member 32 is returned to the horizontal position S1. Since the magnet rollers 42 are rotated about the axis of rotation of the shaft 41 by driving the drive motor 44, the end magnets 34 are repeatedly repulsed away from and attracted to the magnet rollers 42 at a predetermined cycle. With this arrangement, the sheet member 32 is flutteringly moved via the rod member 33. The fluttering movement of the sheet member 32 causes the toner on the sheet member 32 to be securely moved toward the replenishing port 310.

As the toner on the sheet member 32 is significantly decreased, as shown in FIG. 5C, the weight of the toner is significantly decreased. When the north poles of the magnet rollers 42 face the respective corresponding end magnets 34 in this state, the sheet member 32 is set to the maximally tilted position S2. Thereby, a meager amount of toner left on the sheet member 32 is gathered on an area near the replenishing port 310.

In addition to the above operation, the sheet member 32 is oscillatingly moved between the horizontal position S1 and the maximally tilted position S2 in accordance with the up and down movements of the end magnets 34 in response to rotation of the magnet rollers 42. This enables to sweep off the toner remainder from the sheet member 32, and substantially all the toner on the sheet member 32 is replenished to the developer 20 through the replenishing port 310.

Thus, unlike the conventional arrangement, the above arrangement enables to efficiently use the toner, without likelihood that the toner container 30 may be replaced with a new one, with the toner remainder in the container body 31.

As described above in detail, the toner container 30 of the embodiment is detachably attached to the developer 20 for supplying the toner to the surface of the photosensitive drum 131 of the printer 10. The toner container 30 includes; the container body 31 having the bottom wall 311 formed with the replenishing port 310 through which the toner loaded in the container body 31 is replenished to the developer 20; the sheet member 32 which is placed over the substantially entire surface of the bottom wall 311 except for the replenishing port 310, and has the front end 321 fixed to the end portion of the replenishing port 310; the end magnets 34 arranged at the rear end of the sheet member 32; and the guide spaces V for guiding the end magnets 34 up and down. Further, the magnet rollers 42 are provided outside of the container body 31 to apply a repulsion force to the end magnets 34 so that the end magnets 34 are moved upward along the guide spaces V.

In the thus-constructed toner container 30, in a state that the toner is full in the container body 31 of the toner container 30, the sheet member 32 placed on the bottom wall 311 is firmly contacted with the bottom wall 311 against a repulsion force between the end magnets 34 and the magnet rollers 42 due to the weight of the toner. This state is defined as an initial state. As the toner is replenished from the toner container 30 into the developer body 21 from the initial state, the amount of toner in the toner container 30 is gradually decreased. As a result, the repulsion force between the end magnets 34 and the magnet rollers 42 is gradually dominant, as compared with the weight of the toner in the toner container 30. Thereby, the end magnets 34 are moved upward in the guide spaces V.

When the end magnets 34 are moved upward in the guide spaces V, the rear end of the sheet member 32 is moved upward together with the end magnets 34. As a result, the sheet member 32 is gradually tilted, with the replenishing port 310 being set to a lowest position. The tilt angle of the sheet member 32 is maximum immediately before the toner in the toner container 30 is gone. With this arrangement, the toner remainder on the sheet member 32 is moved toward the replenishing port 310 while being guided on the sheet member 32 at the maximally tilted angle position. This enables to efficiently use substantially all the toner in the toner container 30 in replacing with a new toner container, without likelihood that the toner may be left in the toner container 30 before the replacement.

Since the sheet member 32 is tilted, as the amount of toner in the toner container 30 is decreased, it is possible to set the bottom wall 311 of the toner container 30 for supporting the sheet member 32 to a horizontal position in the initial state. This arrangement not only enables to increase the capacity of the toner container 30, as compared with the conventional arrangement, in which the bottom wall corresponding to the bottom wall 311 is formed into the funnel-like shape, but also contributes to miniaturization of the apparatus body 11 of the printer 10 in the case where the toner container 30 substantially with the same capacity as the conventional toner container is used in the printer 10.

Thus, the toner container 30 of the embodiment is advantageous in increasing the capacity of the toner container 30, in contributing to miniaturization of the apparatus body 11 of the printer 10, and in eliminating toner remainder in the container body 31. This enables to use substantially all the toner in the container body 31 without waste, thereby contributing to running cost reduction of the printer 10.

In the embodiment, the magnet rollers 42 are rotatable about the axis of rotation of the shaft 41 by driving the drive motor 44, and the unit magnets are arranged on the peripheral portion of each of the magnet rollers 42 in such a manner that the north pole and the south pole are circumferentially and alternately arranged. With this arrangement, the north poles and the south poles of the magnet rollers 42 are alternately acted on the respective corresponding end magnets 34 by rotating the magnet rollers 42. Thereby, the end magnets 34 are oscillatingly moved up and down, as being repulsed away from the north poles of the magnet rollers 42 and attracted to the south poles of the magnet rollers 42. As a result, the sheet member 32 is flutteringly moved in response to the oscillatory up and down movements of the end magnets 34, and the toner remainder on the sheet member 32 is shaken off from the sheet member 32 toward the replenishing port 310. This securely enables to eliminate likelihood that toner may be left in the toner container.

In the embodiment, since the magnet rollers 42 are arranged in the apparatus body 11 of the printer 10, there is no need of arranging the magnet rollers 42 in the toner container. This enables to simplify the construction of the toner container.

Further, the magnetic field sensor 35 for detecting the end magnet 34 is arranged at such a position that the sheet member 32 is set to a tilt angle position capable of falling substantially all the toner remainder from the sheet member 32. This enables to judge that the container body 31 is empty based on a detection result of the magnetic field sensor 35 for detecting the end magnet 34. Thus, an appropriate time for replacing the toner container 30 with a new one can be easily determined based on the judgment result.

The invention is not limited to the foregoing embodiment, but may embrace the following modifications and/or alterations.

(1) In the embodiment, the printer 10 is described as an example of the image forming apparatus. The invention may be applicable to other image forming apparatus such as a copier or a facsimile machine.

(2) In the embodiment, the magnet rollers 42 facing the respective corresponding end magnets 34 are provided in the apparatus body 11 of the printer 10. Alternatively, the magnet rollers 42 may be provided in the toner container 30. In the modification, the toner container 30 is applicable to a well-known printer, in which magnet rollers 42 are not provided in an apparatus body. This enables to expand the versatile use of the toner container 30.

(3) In the embodiment, the magnet rollers 42 serve as the second magnet, and the magnet rollers 42 are rotatable about the axis of rotation of the shaft 41 by driving the drive motor 44. Alternatively, a single magnet with a pole opposite to the pole of the end magnet 34 may be provided as the second magnet.

In the modification, the second magnet applies a repulsion force against the end magnet 34, and does not attract the end magnet 34. Accordingly, unlike the embodiment in which the magnet rollers 42 are used as the second magnet, the end magnet is not oscillatingly moved up and down. However, the modification exhibits a function that the tilt angle of the sheet member 32 is gradually increased as the amount of toner in the container body 31 is decreased, because a constant repulsion force is generated on the end magnet 34.

Also, unlike the embodiment that the magnet rollers 42 are used as the second magnet, providing the single magnet as the second magnet eliminates the need of providing the elevating mechanism 40 for elevating the end magnets 34 by rotating the magnet rollers 42 in response to driving of the drive motor 44. This enables to simplify the arrangement of the printer.

(4) In the embodiment, the replenishing port 310 of the toner container 30 is formed in one end of the bottom wall 311. Alternatively, the replenishing port may be formed in the middle or an appropriate position of the bottom wall 311. In the modification, however, it is necessary to provide at least two sheet members 32 facing each other with respect to the replenishing port 30, end magnet pairs 34 each of which is provided for each of the sheet members 32, and plural second magnets for elevating the respective end magnet pairs 34.

(5) In the embodiment, the bottom wall 311 of the container body 31 is set horizontally. Alternatively, the bottom wall 311 may be tilted downwardly toward the replenishing port 310 in the initial state. The modification enables to increase the falling effect by tilting the sheet member 32 relative to the tilted bottom wall 311, in addition to the advantage that the bottom wall 311 has a function of falling the toner toward the replenishing port 310. This is further advantageous in eliminating likelihood that toner may be left in the toner container 30.

(6) Alternatively, a bag-like member loaded with a toner, having a part thereof facing the replenishing port 310 being formed into an opening, may be used in place of the sheet member 32. In the modification, the peripheral end of the opening of the bag-like member is fixed to the inner end of the replenishing port 310 with no clearance. Thereby, the toner in the bag-like member is allowed to fall exclusively into the replenishing port 310. This is advantageous in securely preventing the toner from falling onto the bottom wall 311 through a clearance between the end portion of the sheet member 32 and the inner wall of the container body 31, which may occur in the embodiment.

The aforementioned embodiment primarily includes the inventions having the below-mentioned arrangements.

A toner container according to an aspect of the invention comprises: a casing member for loading a toner therein, the casing member including a bottom wall formed with a replenishing port for replenishing the toner to the developer; a sheet member which is placed on the bottom wall, the sheet member including a first end fixed to the casing member near the replenishing port, and a second end opposite to the first end, the second end being made movable up and down; a first magnet which is attached to a lead end of the second end of the sheet member; and a guide member for guiding the up and down movement of the first magnet, wherein the first magnet is upwardly movable while being guided by the guide member by a repulsion force resulting from application of a certain magnetic force to the first magnet.

An image forming apparatus according to another aspect of the invention comprises: an apparatus body; an image carrier incorporated in the apparatus body; a developer for forming a toner image by supplying a toner onto a surface of the image carrier; and a toner container detachably attached to the developer, wherein the toner container has the aforementioned arrangement.

In the above arrangements, as the toner in the toner container is gradually decreased, the repulsion force generated on the first magnet is dominant, as compared with the weight of the toner. Thereby, the first magnet is moved upward along the guide member. Then, the second end of the sheet member is moved upward together with the first magnet, and the sheet member is gradually tilted, with the first end thereof near the replenishing port being set to a lowest position. Immediately before the toner in the toner container is gone, the tilt angle of the sheet member is maximum. With this arrangement, the toner remainder on the sheet member is moved toward the replenishing port, as being guided on the sheet member at the maximally tilted angle position. Thus, the arrangement is advantageous in efficiently using substantially all the toner in the toner container, without toner remainder in the toner container.

Since the sheet member is gradually tilted, as the amount of toner in the toner container is decreased, it is possible to set the bottom wall of the toner container horizontally. This not only enables to increase the capacity of the toner container, as compared with the conventional toner container, in which the bottom wall is formed into a funnel-like shape, but also contributes to miniaturization of the apparatus body of the image forming apparatus, in the case where the toner container with the same capacity as the conventional toner container is used.

Preferably, a second magnet for applying the certain magnetic force to the first magnet may be provided in the casing member. This arrangement enables to readily provide the operation and the effect of the invention, even if the inventive toner container is used in a well-known image forming apparatus, in which the second magnet is not provided in the apparatus body. Thereby, versatile use of the toner container is expanded.

Preferably, a second magnet for applying the certain magnetic force to the first magnet may be provided in the apparatus body. This arrangement enables to eliminate the need of providing a member for applying a certain magnetic force in the toner container, thereby simplifying the construction of the toner container.

Preferably, the second magnet may be a cylindrical magnet roller which is rotatable about a horizontal axis, and the magnet roller may have a peripheral portion where a north pole and a south pole are alternately arranged in a circumferential direction thereof.

In the above arrangement, the north pole and the south pole of the second magnet are alternately acted on the first magnet, as the magnet roller is rotated. Thereby, the first magnet is attracted to and repulsed away from the second magnet, and the first magnet is oscillatingly moved up and down. With this arrangement, since the sheet member is flutteringly moved by the oscillatory up and down movements of the first magnet, the toner remainder on the sheet member is moved toward the replenishing port by the fluttering movement of the sheet member. This enables to eliminate likelihood that the toner may be left in the toner container.

Preferably, the first end of the sheet member may be fixed to an end portion of the replenishing port. Particularly preferably, the sheet member may be placed over a substantially entire surface of the bottom wall except for the replenishing port, and a portion of the sheet member corresponding to an end portion of the replenishing port may be fixed to the end portion of the replenishing port.

In the above arrangement, the end portion of the sheet member except for the first end facing the replenishing port is firmly contacted with the inner wall of the casing member with no clearance in a state that the sheet member is placed over the bottom wall. This arrangement enables to prevent the toner from falling onto the bottom wall through a clearance between the end portion of the sheet member and the inner wall of the casing member, even if the sheet member is tilted.

Preferably, the bottom wall may have a rectangular shape in plan view, and may be set to a substantially horizontal position, the first end of the bottom wall may be formed with the replenishing port, the first magnet may be arranged on the second end opposite to the first end, the sheet member may be placed over a substantially entire surface of the bottom wall except for the replenishing port, and the sheet member may be tilted by a predetermined angle with respect to the bottom wall in such a manner that the first end of the sheet member is set to a lowest position, as the second end of the sheet member is raised by the upward movement of the first magnet.

Preferably, a sensor may be provided in the casing member for detecting whether the first magnet has reached a predetermined height position. In this case, preferably, the sensor may be so constructed as to detect the first magnet when the toner in the casing member is substantially consumed.

The above arrangement enables to determine that the toner in the casing member is empty based on a detection result of the sensor for detecting the end magnet.

This application is based on Japanese Patent Application No. 2006-139029 filed on May 18, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A toner container adapted to be detachably attached to a developer provided in an apparatus body of an image forming apparatus, the toner container comprising:

a casing member for loading a toner therein, the casing member including a bottom wall formed with a replenishing port for replenishing the toner to the developer;

a sheet member placed on the bottom wall, the sheet member including a first end fixed to the casing member near the replenishing port, and a second end opposite to the first end, the second end being made movable up and down;

a first magnet attached to a lead end of the second end of the sheet member; and a guide member for guiding the up and down movement of the first magnet, wherein the first magnet is upwardly movable while being guided by the guide member by a repulsion force resulting from application of a certain magnetic force to the first magnet.

2. The toner container according to claim 1, further comprising:

a second magnet, provided in the casing member, for applying the certain magnetic force to the first magnet.

3. The toner container according to claim 2, wherein the second magnet is a cylindrical magnet roller which is rotatable about a horizontal axis, and the magnet roller has a peripheral portion where a north pole and a south pole are alternately arranged in a circumferential direction thereof.

4. The toner container according to claim 1, wherein the first end of the sheet member is fixed to an end portion of the replenishing port.

5. The toner container according to claim 1, wherein the sheet member is placed over a substantially entire surface of the bottom wall except for the replenishing port, and a portion of the sheet member corresponding to an end portion of the replenishing port is fixed to the end portion of the replenishing port.

6. The toner container according to claim 1, wherein the bottom wall has a rectangular shape in plan view, and is set to a substantially horizontal position, the first end of the bottom wall is formed with the replenishing port, and the first magnet is arranged on the second end opposite to the first end, the sheet member is placed over a substantially entire surface of the bottom wall except for the replenishing port, and the sheet member is tilted by a predetermined angle with respect to the bottom wall in such a manner that the first end of the sheet member is set to a lowest position, as the second end of the sheet member is raised by the upward movement of the first magnet.

7. The toner container according to claim 1, further comprising:

a sensor, provided in the casing member, for detecting whether the first magnet has reached a predetermined height position.

8. The toner container according to claim 7, wherein the sensor is so constructed as to detect the first magnet when the toner in the casing member is substantially consumed.

9. An image forming apparatus comprising:

an apparatus body;

an image carrier incorporated in the apparatus body;

a developer for forming a toner image by supplying a toner onto a surface of the image carrier; and a toner container detachably attached to the developer, wherein the toner container includes:

a casing member for loading the toner therein, the casing member having a bottom wall formed with a replenishing port for replenishing the toner to the developer;

a sheet member placed on the bottom wall, the sheet member having a first end fixed to the casing member near the replenishing port, and a second end opposite to the first end, the second end being made movable up and down;

a first magnet attached to a lead end of the second end of the sheet member; and a guide member for guiding the up and down movement of the first magnet, wherein the first magnet is upwardly movable while being guided by the guide member by a repulsion force resulting from application of a certain magnetic force to the first magnet.

10. The image forming apparatus according to claim 9, further comprising:

a second magnet, provided in the casing member, for applying the certain magnetic force to the first magnet.

11. The image forming apparatus according to claim 9, further comprising:

a second magnet, provided in the apparatus body, for applying the predetermined force to the first magnet.

12. The image forming apparatus according to claim 11, wherein the second magnet is a cylindrical magnet roller which is rotatable about a horizontal axis, and the magnet roller has a peripheral portion where a north pole and a south pole are alternately arranged in a circumferential direction thereof.

13. The image forming apparatus according to claim 9, wherein the first end of the sheet member is fixed to an end portion of the replenishing port.

14. The image forming apparatus according to claim 9, wherein the sheet member is placed over a substantially entire surface of the bottom wall except for the replenishing port, and a portion of the sheet member corresponding to an end portion of the replenishing port is fixed to the end portion of the replenishing port.

15. The image forming apparatus according to claim 9, wherein the bottom wall has a rectangular shape in plan view, and is set to a substantially horizontal position, the first end of the bottom wall is formed with the replenishing port, and the first magnet is arranged on the second end opposite to the first end, the sheet member is placed over a substantially entire surface of the bottom wall except for the replenishing port, and the sheet member is tilted by a predetermined angle with respect to the bottom wall in such a manner that the first end of the sheet member is set to a lowest position, as the second end of the sheet member is raised by the upward movement of the first magnet.

16. The image forming apparatus according to claim 9, further comprising:

a sensor, provided in the casing member, for detecting whether the first magnet has reached a predetermined height position.

17. The image forming apparatus according to claim 16, wherein the sensor is so constructed as to detect the first magnet when the toner in the casing member is substantially consumed.

* * * * *